US011396043B2

(12) United States Patent
Kim et al.

(10) Patent No.: US 11,396,043 B2
(45) Date of Patent: Jul. 26, 2022

(54) OPEN-CELL TYPE POROUS ALUMINUM MANUFACTURING METHOD AND OPEN-CELL TYPE POROUS ALUMINUM MANUFACTURED THEREBY

(71) Applicants: HYUNDAI MOTOR COMPANY, Seoul (KR); KIA CORPORATION, Seoul (KR); RESEARCH & BUSINESS FOUNDATION SUNGKYUNKWAN UNIVERSITY, Suwon-si (KR)

(72) Inventors: Jongmin Kim, Anyang-si (KR); Taekyu Ha, Daegu (KR); Youngki Lee, Suwon-si (KR); Chui Hong Bae, Suwon-si (KR); Jaehyung Lee, Gwacheon-si (KR); Youngjig Kim, Suwon-si (KR)

(73) Assignees: HYUNDAI MOTOR COMPANY, Seoul (KR); KIA CORPORATION, Seoul (KR); RESEARCH & BUSINESS FOUNDATION SUNGKYUNKWAN UNIVERSITY, Suwon-si (KR)

( * ) Notice: Subject to any disclaimer, the term of this patent is extended or adjusted under 35 U.S.C. 154(b) by 0 days.

(21) Appl. No.: 17/408,206

(22) Filed: Aug. 20, 2021

(65) Prior Publication Data

US 2022/0176444 A1 Jun. 9, 2022

(30) Foreign Application Priority Data

Dec. 4, 2020 (KR) ..... 10-2020-0168360

(51) Int. Cl.
*B22D 25/00* (2006.01)
*B22D 27/00* (2006.01)
*B22D 18/06* (2006.01)

(52) U.S. Cl.
CPC ..... *B22D 25/005* (2013.01); *B22D 18/06* (2013.01); *B22D 27/003* (2013.01)

(58) Field of Classification Search
CPC ..... B22D 25/005; B22D 18/00; B22D 18/02; B22D 18/06; B22D 27/003; B22D 19/00; B22D 19/009
See application file for complete search history.

(56) References Cited

U.S. PATENT DOCUMENTS 8,151,860 B2 * 4/2012 Mortensen ..... B22C 9/105 164/520

* cited by examiner

*Primary Examiner* — Kevin P Kerns
*Assistant Examiner* — Steven S Ha
(74) *Attorney, Agent, or Firm* — Lempia Summerfield Katz LLC

(57) ABSTRACT

A method of manufacturing an open-cell type of porous aluminum includes: manufacturing a space-holder by using a water-soluble salt powder; stacking the space-holder in a container, and manufacturing an open-cell type of porous aluminum by injecting molten aluminum.

15 Claims, 5 Drawing Sheets

OPEN-CELL TYPE POROUS ALUMINUM MANUFACTURING METHOD AND OPEN-CELL TYPE POROUS ALUMINUM MANUFACTURED THEREBY

CROSS-REFERENCE TO RELATED APPLICATION

This application claims priority to and the benefit of Korean Patent Application No. 10-2020-0168360 filed in the Korean Intellectual Property Office on Dec. 4, 2020, the entire contents of which are incorporated herein by reference.

BACKGROUND

(a) Field of the Disclosure

The present disclosure relates to a method of manufacturing an open-cell type of porous aluminum and to an open-cell type of porous aluminum manufactured thereby.

(b) Description of the Related Art

A porous metal refers to a metal in which pores exist inside the metal. A porous metal with numerous bubbles inside the metal has a lightweight and high specific strength due to its porous structure.

Particularly, an open-cell type of porous aluminum has an excellent heat/mass transport characteristic since pores inside the material are interconnected allowing gas or fluid to easily pass therethrough. In addition, an open-cell type of porous aluminum has excellent energy absorption ability and a weight reduction effect due to an effect of internal pores and may be applied to various fields by controlling a shape, a size, a distribution, and porosity of pores in an alloy.

Due to recent global environmental conservation and stricter $CO_2$ gas emission regulations, it is essential to reduce weight for fuel efficiency in a vehicular industry field. Accordingly, a porous metal manufactured using aluminum with a low specific gravity may be applied to various parts such as battery cases that utilize thermal properties and shock absorbing members that utilize energy absorbing ability.

However, in the case of a precision casting method using urethane foam or a sintering method using a salt powder and a metal powder, which are conventional methods for manufacturing a porous metal, due to a complicated manufacturing process and high cost, an open-cell type of porous aluminum is currently applied only to some heat exchangers and heat sinks.

Therefore, when process simplification and cost reduction are realized through development of an innovative process different from the existing porous metal manufacturing methods, it is expected that the porous metal may be applied to various fields due to its excellent thermal properties, shock absorption ability, and weight reduction effect.

The above information disclosed in this Background section is only to enhance understanding of the background of the disclosure. Therefore, the Background section may contain information that does not form the prior art that is already known in this country to a person of ordinary skill in the art.

SUMMARY

An embodiment is to provide a method of manufacturing an open-cell type of porous aluminum that has no limitation on a shape and size of a product and that may reduce production costs by simplifying a process while increasing productivity compared to the existing process.

An embodiment of the present disclosure provides a method of manufacturing an open-cell type of porous aluminum. The method includes: manufacturing a space-holder by using a water-soluble salt powder; stacking the space-holder in a container; and manufacturing an open-cell type of porous aluminum by injecting molten aluminum.

The manufacturing of the space-holder may include dissolving and casting the water-soluble salt powder to manufacture a complex salt and crushing the complex salt.

The water-soluble salt may be a water-soluble salt containing cations of $K^+$ or $Na^+$ and anions of $Cl^-$ or $CO_3^{2-}$.

The water-soluble salt may include 0 mol % to 20 mol % of KCl and 80 mol % to 100 mol % of $Na_2CO_3$, based on a total weight of the water-soluble salt.

The space-holder may have a diameter of 0.1 mm to 5 mm.

The stacking of the space-holder in the container may include positioning a second filter at a lower portion of the container, positioning the space-holder on the second filter, and positioning a first filter on the space-holder.

The first filter or the second filter may include SiC, $Al_2O_3$, $ZrO_2$, or a combination thereof.

The first filter or the second filter may have 10 pores per inch (ppi) to 40 ppi.

The method of manufacturing the open-cell type of porous aluminum by injecting the molten aluminum may include filling the molten aluminum into the stacked space-holder through a gas pressurization method.

The method of manufacturing the open-cell type of porous aluminum by injecting the molten aluminum may include preheating the stacked space-holder, injecting the molten aluminum into the container, and pressurizing the inside of the container with an inert gas after injecting the molten aluminum.

A preheating temperature of the space-holder may be 400° C. to 700° C.

An injecting temperature of the molten aluminum is 700° C. to 800° C.

The injecting of the molten aluminum into the container may include vacuum-reducing a pressure of the inside of the container.

The pressurizing of the inside of the container with the inert gas may include injecting argon (Ar) gas into the container to pressurize the container to 1 bar to 3 bar.

The method of manufacturing an open-cell type of porous aluminum may further include removing the space-holder remaining in the manufactured open-cell type of porous aluminum.

The removal of the space-holder remaining in the manufactured open-cell type of porous aluminum may include removing the space-holder by dissolving the space-holder in water.

Another embodiment of the present disclosure provides an open-cell type of porous aluminum manufactured by the open-cell type of porous aluminum manufacturing method described above.

According to an embodiment of the method of manufacturing an open-cell type of porous aluminum, it is possible to implement a product without limitation on a shape and size of the product and to reduce production costs by simplifying a process while increasing productivity compared to the existing process.

DETAILED DESCRIPTION OF THE EMBODIMENTS

Advantages and features of the present disclosure and methods of accomplishing the same may be understood more readily by reference to the following detailed description of embodiments and the accompanying drawings. However, this disclosure may be embodied in many different forms and is not to be construed as limited to the embodiments set forth herein. Unless otherwise defined, all terms (including technical and scientific terms) used herein have the same meaning as commonly understood by one of ordinary skill in the art. It should be further understood that terms, such as those defined in commonly used dictionaries, should be interpreted as having a meaning that is consistent with their meaning in the context of the relevant art and the present disclosure. Such terms should not be interpreted in an idealized or overly formal sense unless expressly so defined herein. Throughout the specification, unless explicitly described to the contrary, the word "comprise" and variations such as "comprises" or "comprising" should be understood to imply the inclusion of stated elements but not the exclusion of any other elements.

Further, as used herein, the singular forms "a", "an", and "the" are intended to include the plural forms as well, unless the context clearly indicates otherwise.

A method of manufacturing an open-cell type of porous aluminum according to an embodiment includes manufacturing a space-holder; stacking the space-holder in a container; and injecting molten aluminum thereinto to manufacture an open-cell type of porous aluminum.

Figure 1:
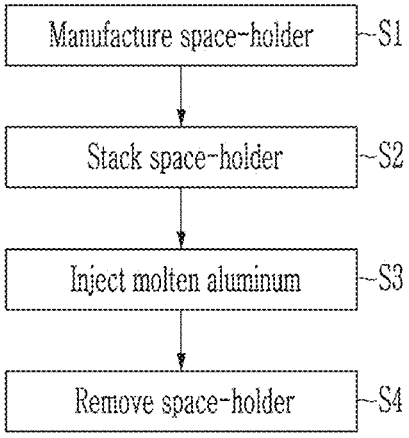
FIG. 1 illustrates a flowchart of a method of manufacturing an open-cell type of porous aluminum according to an embodiment.

FIG. 1 illustrates a flowchart of a method of manufacturing an open-cell type of porous aluminum according to an embodiment. The method of manufacturing an open-cell type of porous aluminum is described in detail with reference to FIG. 1.

First, a space-holder is manufactured by using a water-soluble salt powder (S1).

Specifically, the manufacturing of the space-holder may include dissolving and casting a water-soluble salt powder to manufacture a complex salt and may include crushing the complex salt.

The water-soluble salt may be a water-soluble salt containing cations of $K^+$ or $Na^+$ and anions of $Cl^-$ or $CO_3^{2-}$. The water-soluble salt includes the cations and anions, thereby having satisfactory strength and forming pores in the open-cell type of porous aluminum during aluminum casting.

For example, the water-soluble salt may include KCl, $Na_2CO_3$, or a combination thereof. In this case, the water-soluble salt may include 0 mol % to 20 mol % of KCl and 80 mol % to 100 mol % of $Na_2CO_3$, based on a total weight of the water-soluble salt. The water-soluble salt has different melting temperatures according to respective mixing ratios. Since the melting temperature also increases as a content of $Na_2CO_3$ increases, a water-soluble salt of an appropriate mixing ratio may be selected and used in consideration of a temperature of an aluminum alloy molten metal to be used. For example, a water-soluble salt including 20 mol % of KCl and 80 mol % of $Na_2CO_3$ may have a melting temperature of about 745° C. A water-soluble salt including 10 mol % of KCl and 90 mol % of $Na_2CO_3$ may have a melting temperature of about 810° C. A water-soluble salt including 100 mol % of $Na_2CO_3$ may have a melting temperature of about 851° C.

The complex salt may be manufactured by dissolving the water-soluble salt powder to manufacture a liquid salt, and then injecting the molten salt into a mold, thereby manufacturing the complex salt. For example, the water-soluble salt powder may be uniformly kneaded by using a stirrer for 1 minute to 1 hour. The kneaded water-soluble salt powder may be charged into an Fe crucible and dissolved by using an electric furnace at 700° C. to 900° C. to manufacture a liquid salt in a uniform liquid state. Then the salt in a molten state may be injected into a mold to manufacture the complex salt.

The manufactured complex salt is crushed by using a crusher for use as a space-holder and classified into 0.1 mm to 5 mm by using a sieve vibrator for 1 minute to 1 hour. A size of the space-holder is selected and used to control a pore size of a desired open-cell type of porous aluminum. In the case of the manufactured space-holder, since the crushing process is used, the manufactured space-holder has an angled shape, and there is no difference in size and shape according to a mixing ratio.

Next, the manufactured space-holder is stacked in a container (S2).

When manufacturing the open-cell type of porous aluminum by using the water-soluble salt space-holder, the space-holder is an element that may form pores in the open-cell type of porous aluminum. Therefore, a pore rate of the open-cell type of porous aluminum is determined by a stacking density of the space-holder in the container.

When the space-holder is stacked, the pores in the space-holder may be adjusted by using ramming through a rod bar or mechanical vibration. When space-holders are stacked, the space-holders may be densely stacked according to an increase in the number of ramming times or mechanical vibration time, and a density of space-holders within a unit area increases. This means that a pore rate of a product increases when the open-cell type of porous aluminum is manufactured.

When the number of ramming times and the mechanical vibration time are decreased, the pore rate of the open-cell type of porous aluminum is reduced. As a large number of pores are formed in the space-holder, all pores may not be connected, so a closed-cell type of pores may be formed.

On the other hand, the stacking of the space-holder in the container may include positioning a second filter at a lower portion of the container, positioning the space-holder on the second filter, and positioning a first filter on the space-holder.

Figure 2:
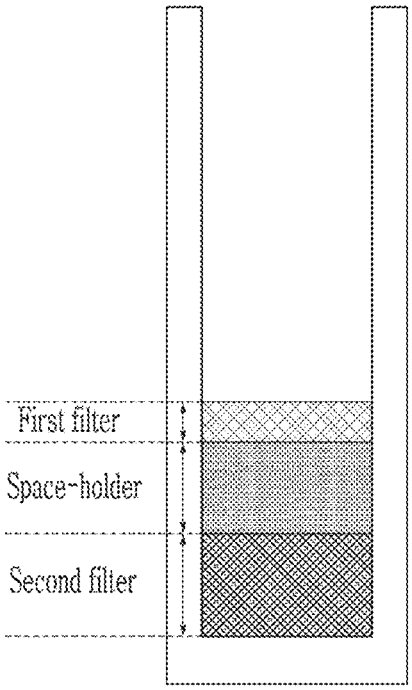
FIG. 2 illustrates a schematic cross-sectional view of a container in which a space-holder is stacked.

FIG. 2 illustrates a schematic cross-sectional view of a container in which a space-holder is stacked. Referring to FIG. 2, the space-holder is stacked in the container, the first filter is positioned on the space-holder, and the second filter is positioned under the space-holder.

When the open-cell type of porous aluminum is manufactured, molten aluminum is injected toward an upper side thereof. In this case, in order to prevent the space-holder from floating due to the density difference and turbulence between the molten aluminum and the space-holder, the first filter is positioned on the space-holder.

The open-cell type of porous aluminum manufacturing method according to an embodiment uses a gas pressurization method in which the molten aluminum is filled into the space-holder by using an inert gas after the molten aluminum is injected, as described below. In this case, in order to allow gas remaining therein to escape from the pores in the space-holder, the second filter is positioned under the space-holder.

Through this, the space-holder is fixed between the first filter and the second filter. All of the residual gas may be collected in the lower portion of the space-holder and the molten aluminum may be completely filled in the pores in the space-holder.

The first filter or the second filter should be able to maintain a sound shape without reactivity when in contact with high-temperature molten aluminum. Therefore, the first filter or the second filter may include SiC, $Al_2O_3$, $ZrO_2$, or a combination thereof.

In addition, the first filter or the second filter may have 10 pores per inch (ppi) to 40 ppi. For example, the first filter or the second filter may have 10 ppi to 30 ppi in the case of SiC, may have 20 ppi to 30 ppi in the case of $Al_2O_3$, and may have 10 ppi to 20 ppi in the case of $ZrO_2$.

Next, the molten aluminum is injected to manufacture the open-cell type of porous aluminum (S3).

Since the molten aluminum has a large surface tension, it is not easy to penetrate into the space-holder. Accordingly, in the open-celled porous aluminum manufacturing method, according to the embodiment, a gas pressurization method of filling the molten aluminum into the space-holder by using an inert gas after injecting the molten aluminum is used. In this case, in order to facilitate the filling of the molten aluminum into the space-holder, by setting the preheating temperature and the molten aluminum temperature of the space-holder, it is possible to manufacture a high-quality open-cell type of porous aluminum.

Specifically, the manufacturing of the open-cell type of porous aluminum by injecting the molten aluminum may include preheating the stacked space-holder, injecting the molten aluminum into the container, and pressurizing the inside of the container with an inert gas after injecting the molten aluminum.

Figure 3:
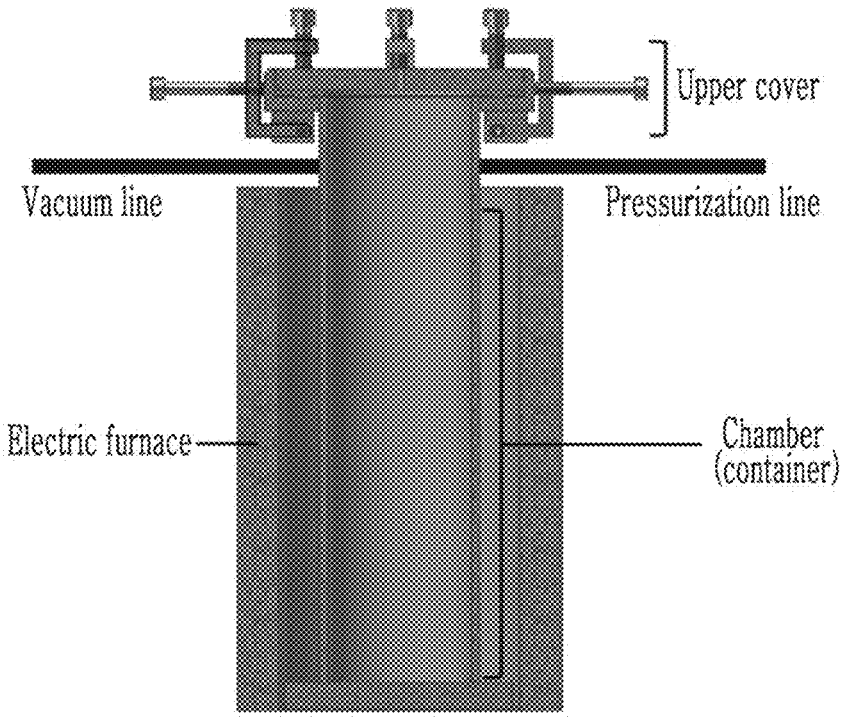
FIG. 3 illustrates a schematic cross-sectional view of a pressurization chamber that may be used in an open-cell type of porous aluminum manufacturing process.

FIG. 3 illustrates a schematic cross-sectional view of a pressurization chamber that may be used in the method of manufacturing an open-cell type of porous aluminum by injecting the molten aluminum.

Referring to FIG. 3, the pressurization chamber includes a temperature controller of an electric furnace capable of preheating the space-holder at the outside thereof and includes a molten aluminum inlet at an upper portion thereof, which may be fastened through a cover. In addition, since a vacuum line and a pressurization line are connected to the upper portion of the chamber, by using them, it is possible to remove internal residual gas or to fill the molten aluminum through pressurization.

As described above, after the space-holder is stacked in the container, the space-holder is preheated to 400° C. to 700° C. by using the electric furnace. After the preheating is completed, the previously melted molten aluminum at 700° C. to 800° C. is injected through the upper inlet. When the preheating temperatures of the space-holder and the molten aluminum temperature are low, or the fluidity and pressure of the molten aluminum are low, the pores in the space-holder may not be sufficiently filled due to early solidification.

In this case, the pressure may be reduced for 0 seconds to 60 seconds by using a vacuum pump in order to reduce the residual gas inside. This is to minimize the residual gas inside when the molten aluminum is pressurized.

After the molten aluminum is injected, the inert gas is pressurized to 1 bar to 3 bar through the pressurization line to fill the molten aluminum into the space-holder. In this case, argon (Ar) gas may be used as the inert gas.

In addition, the pressure in the chamber during casting is maintained at 1 bar to 3 bar and the shape and size of the open-cell type of porous aluminum may be changed through the design of the container.

Finally, the space-holder remaining in the manufactured open-cell type of porous aluminum may be removed. The space-holder may be removed by dissolving the space-holder in water and desalting it.

A water-soluble salt space-holder remains inside the processed open-cell type of porous aluminum. Since the space-holder is water-soluble, the space-holder is desalted by using water.

In the desalting, the space-holder may be sufficiently dissolved just by immersing the manufactured open-cell type of porous aluminum in water, the residual salt may be effectively removed by setting the water temperature and stirring conditions to shorten the time, and as necessary, mechanical vibration and ultrasonic waves may be applied.

On the other hand, since the first filter and the second filter are connected to the upper and lower portions of the manufactured open-cell type of porous aluminum, the filters may be cut by processing the upper and lower portions before the desalting.

Manufacturing an open-cell type of porous aluminum by conventional investment casting includes designing a polymer foam (template), manufacturing a polymer foam, injecting a refractory material into a cavity inside the template, burning the template, injecting molten aluminum, and removing the refractory material. Thus, the conventional investment casting manufacturing method has disadvantages in that the manufacturing process is complicated, the manufacturing cost is high, and the production quantity is low.

In addition, manufacturing an open-cell type of porous aluminum by the sintering method includes manufacturing an aluminum and salt powder, mixing the aluminum and salt powder, stacking the mixed powder, performing hot press compression and sintering, and removing the salt. Thus, the sintering manufacturing method has disadvantages in that there is a limitation in a size of a product and there is trapped salt according to a volume ratio.

In contrast, according to a disclosed embodiment of a method of manufacturing an open-cell type of porous aluminum, it is possible to implement a product without limitation on a shape and size of the product and to reduce production costs by simplifying a process while increasing productivity compared to the existing process.

An open-cell type of porous aluminum, according to another embodiment, is manufactured by the open-cell type porous aluminum manufacturing method described above.

Hereinafter, specific embodiments of the present disclosure are described. However, the following described examples are only for illustrating the inventive concept more specifically, and thus the scope of the disclosure should not be limited by these examples.

Manufacturing Example; Manufacturing Open-Cell Type Porous Aluminum

Example 1

20 mol % of KCl and 80 mol % of $Na_2CO_3$ were uniformly kneaded for 30 minutes by using a stirrer. Next, the kneaded salt powder was charged into an Fe crucible and dissolved by using an electric furnace at 900° C. to manufacture a uniform liquid salt in a molten state. Next, the salt in the molten state was injected into a mold to manufacture a complex salt.

Figure 4:
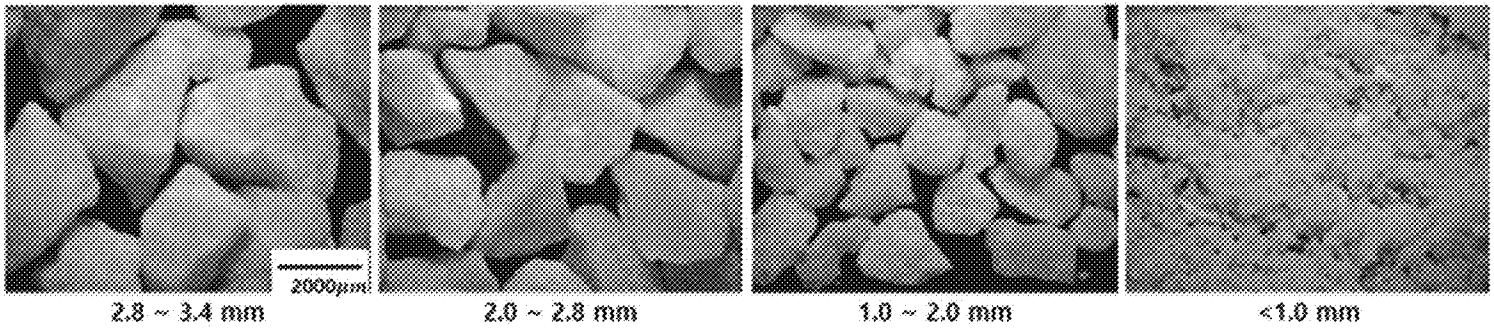
FIG. 4 illustrates photographs of a complex salt classified in Example 1.

The manufactured complex salt was crushed by using a crusher and classified into 0.1 mm to 5 mm by using a sieve vibration machine for 30 minutes. Photographs of the classified complex salt are shown in FIG. 4.

After mounting the SiC second filter of 30 ppi at the lower portion of the container, the space-holder was stacked on the second filter. When stacking the space-holder, ramming using a rod bar was divided and performed 2 to 5 times to control the pores in the space-holder. The SiC first filter of 30 ppi was mounted on the stacked space-holder.

The space-holder was preheated at 650° C. by using an electric furnace. After the preheating was completed, the previously melted molten aluminum of 730° C. was injected through the upper inlet. In this case, in order to reduce the residual gas inside, the pressure was reduced for 30 seconds by using a vacuum pump.

After the molten aluminum was injected, argon gas was pressurized to 2 bar through a pressure line to fill the molten aluminum in the space-holder. During the casting, the pressure in the chamber was maintained at 2 bar.

The upper and lower sides of the manufactured open-cell type of porous aluminum were processed so that the filter portion was cut. The processed open-cell type of porous aluminum was immersed in water for 3 to 5 hours to desalinate the water-soluble salt space-holder remaining inside the open-cell type of porous aluminum.

Figure 5:
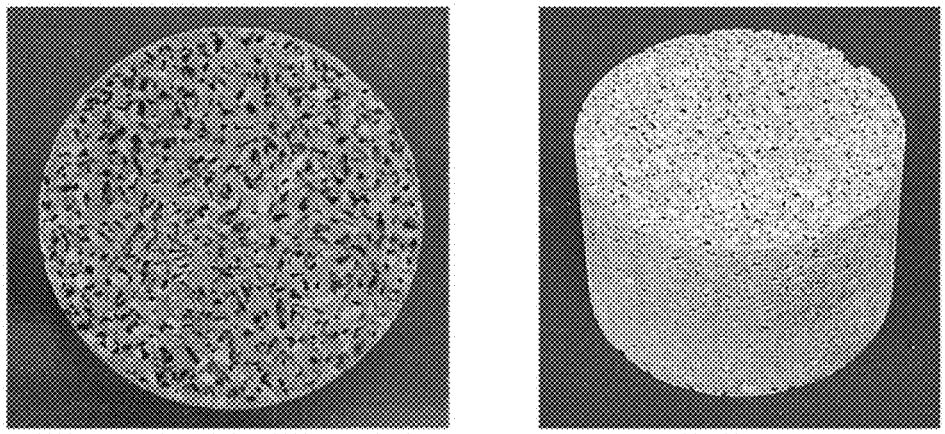
FIG. 5 illustrates photographs of an open-cell type of porous aluminum manufactured in Example 1.

Photographs of the manufactured open-cell type of porous aluminum is shown in FIG. 5.

While this disclosure has been described in connection with what are presently considered to be practical embodiments, it should be understood that the disclosure is not limited to the disclosed embodiments. On the contrary, this disclosure is intended to cover various modifications and equivalent arrangements included within the spirit and scope of the appended claims.

What is claimed is:

1. A method of manufacturing an open-cell type of porous aluminum, the method comprising:

manufacturing a space-holder by using a water-soluble salt powder;

stacking the space-holder in a container; and manufacturing the open-cell type of porous aluminum by injecting molten aluminum, wherein the manufacturing of the space-holder includes dissolving and casting the water-soluble salt powder to manufacture a complex salt and crushing the complex salt.

2. The method of claim 1, wherein the water-soluble salt is a water-soluble salt containing cations of $K^+$ or $Na^+$ and anions of $Cl^-$ or $CO_3^{2-}$.

3. The method of claim 1, wherein the water-soluble salt includes 0 mol % to 20 mol % of KCl and 80 mol % to 100 mol % of $Na_2CO_3$, based on a total weight of the water-soluble salt.

4. The method of claim 1, wherein the space-holder has a diameter of 0.1 mm to 5 mm.

5. The method of claim 1, wherein the stacking of the space-holder in the container includes:

positioning a second filter at a lower portion of the container;

positioning the space-holder on the second filter; and positioning a first filter on the space-holder.

6. The method of claim 5, wherein the first filter or the second filter includes SiC, $Al_2O_3$, $ZrO_2$, or a combination thereof.

7. The method of claim 5, wherein the first filter or the second filter has 10 pores per inch (ppi) to 40 ppi.

8. The method of claim 1, wherein the manufacturing of the open-cell type of porous aluminum by injecting the molten aluminum includes filling the molten aluminum into the stacked space-holder through a gas pressurization method.

9. The method of claim 8, wherein the manufacturing of the open-cell type of porous aluminum by injecting the molten aluminum includes:

preheating the stacked space-holder;

injecting the molten aluminum into the container; and after the molten aluminum is injected, pressurizing the inside of the container with an inert gas.

10. The method of claim 9, wherein a preheating temperature of the space-holder is 400° C. to 700° C.

11. The method of claim 9, wherein an injecting temperature of the molten aluminum is 700° C. to 800° C.

12. The method of claim 9, wherein the injecting of the molten aluminum into the container includes vacuum-reducing a pressure of the inside of the container.

13. The open-cell type of porous aluminum manufacturing method of claim 9, wherein the pressurizing of the inside of the container with the inert gas includes injecting argon (Ar) gas into the container to pressurize the container to 1 bar to 3 bar.

14. The method of claim 1, further comprising:

removing the space-holder remaining in the manufactured open-cell type of porous aluminum.

15. The method of claim 14, wherein the removing of the space-holder remaining in the manufactured open-cell type of porous aluminum includes removing the space-holder by dissolving it in water.

* * * * *